US005938326A

United States Patent [19]

Krivohlavek et al.

[11] Patent Number: 5,938,326

[45] Date of Patent: Aug. 17, 1999

[54] COMBINATION DISPERSION AND SKIMMING DEVICE

[75] Inventors: Dennis Krivohlavek, Claremore, Okla.; Robert Z. Johnson, Fort Smith, Ark.

[73] Assignee: Asphalt Technology & Consulting, Inc., Claremore, Okla.

[21] Appl. No.: 08/899,900

[22] Filed: Jul. 24, 1997

[51] Int. Cl.[6] ..... B01F 5/00; B01F 5/10

[52] U.S. Cl. ..... 366/137; 366/173.2

[58] Field of Search ..... 366/131, 136, 366/137, 159.1, 167.1, 173.1, 174.1, 173.2, 175.2; 210/169, 194, 195.3, 167, 776; 137/577, 577.5, 578

[56] References Cited

U.S. PATENT DOCUMENTS

| | | | |
|---|---|---|---|
| Re. 29,496 | 12/1977 | Dydzyk | 366/25 |
| 981,098 | 1/1911 | McCaskell | 366/136 |
| 2,342,559 | 2/1944 | Sebald et al. . | |
| 2,437,694 | 3/1948 | Hickman | 366/137 |
| 2,577,797 | 12/1951 | Moyer | 366/136 |
| 2,961,098 | 11/1960 | Nash | 210/169 |
| 3,116,912 | 1/1964 | Finsberg . | |
| 3,160,588 | 12/1964 | Alarie | 210/169 |
| 3,233,874 | 2/1966 | Betulius | 366/136 |
| 3,271,304 | 9/1966 | Valdespino et al. | 366/137 |
| 3,953,001 | 4/1976 | Gleockler | 366/137 |
| 4,068,828 | 1/1978 | Goins | 366/136 |
| 4,084,796 | 4/1978 | Krehbiel | 366/137 |
| 4,130,365 | 12/1978 | Sittig | 366/137 |
| 4,170,420 | 10/1979 | Underwood | 366/137 |
| 4,252,445 | 2/1981 | Undewood | 366/137 |
| 4,285,601 | 8/1981 | Miner | 366/137 |
| 4,285,602 | 8/1981 | Hagerty et al. | 366/177 |
| 4,340,308 | 7/1982 | Tharp | 366/2 |
| 4,358,298 | 11/1982 | Ratcliff | 55/185 |
| 4,447,157 | 5/1984 | Underwood | 366/137 |
| 4,580,904 | 4/1986 | Hacheney | 366/137 |
| 4,660,988 | 4/1987 | Hara et al. | 366/137 |
| 4,812,045 | 3/1989 | Rivers | 366/107 |
| 4,869,657 | 9/1989 | Kurokawa | 417/423.14 |
| 4,956,100 | 9/1990 | Mikkleson | 210/717.6 |
| 4,986,293 | 1/1991 | Schertenleib | 134/168 R |
| 5,599,457 | 2/1997 | Fanning et al. | 210/776 |

FOREIGN PATENT DOCUMENTS

| | | | |
|---|---|---|---|
| 1142557 | 9/1957 | France | 366/137 |

*Primary Examiner*—Tony G. Soohoo
*Attorney, Agent, or Firm*—Head, Johnson & Kachigian

[57] ABSTRACT

A mixing system and a method of mixing a relatively low specific gravity substance and a relatively high specific gravity substance are provided. The system includes a tank for containing a mixture, and an adjustable tube having an intake, wherein the adjustable tube is located within the tank and is adjustable for positioning the intake proximate an upper surface of the mixture for drawing in matter having a tendency to float on the surface of the mixture. The system also includes a circulating means for drawing matter out through the adjustable tube and back into the tank via a dispersion tube. The dispersion tube is constructed to allow the mixture to be recirculated throughout the tank or directed to a selected lower portion of the tank. The method includes the steps of containing a relatively low specific gravity substance and a relatively high specific gravity substance within a tank, positioning an intake of an adjustable tube proximate an tipper surface of the substances, skimming the relatively low specific gravity substance from the upper surface of the substances with the intake of the adjustable tube, and recirculating the relatively low specific gravity substance through a dispersion tube for dispersing the substance throughout the tank at selected vertical distances from a floor of the tank.

15 Claims, 3 Drawing Sheets

COMBINATION DISPERSION AND SKIMMING DEVICE

BACKGROUND OF THE INVENTION

1. Field of the Invention

The present invention relates to a dispersion and skimming device for use as a mixing system. More particularly, the invention relates to a system for mixing substances having different specific gravities. Mixtures of such substances pose difficulties due to the tendency of the substance having a lower specific gravity to separate and float on top of the mixture.

2. Related Art

Attempts have been made at addressing the difficulty of mixing materials having different specific gravities. The tendency of materials having different specific gravities to separate, whereby the low specific gravity material floats on top of the material having a higher specific gravity, requires that mixing be thorough and continuous.

Related mixing devices include U.S. Pat. No. 2,342,559 to Sebald et al. for a Mixing Device for Water Treating Apparatus; U.S. Pat. No. 4,084,796 to Krehbiel for a Liquid Mixing Device; U.S. Pat. No. 4,170,420 to Underwood for a Fluid Mixing System; U.S. Pat. No. 4,660,988 to Hara et al. for a Stirring Device for Liquid Material; and U.S. Pat. No. 4,986,293 to Schertenleib for a Cleaning System.

Previous mixing devices generally teach an inlet wherein fluid is drawn through tubing to a circulation means. The fluid is then recirculated into a mixing device through a discharge means. Previously used inlet means include a pivoting inlet pipe, wherein the inlet can be positioned at various heights, and a tube positioned inside a tank that has an elongated spiral slot, wherein the tube draws in liquids at various depths in the tank. Other inlet means include a suction conduit having a plurality of inductor inlets.

The material drawn into the inlet tube of the mixing system is typically recirculated and discharged back into the mixing tank by various means. Such means include returning the fluid through the bottom of the tank where the fluid passes through a diffuser. Other means include introducing liquid back into the tank through a discharge port, introducing fluid into an injector conduit, and withdrawing liquid material from a stirring tank and returning the material through a nozzle pipe through a plurality of nozzle holes.

Insofar as Applicant is aware, no previous device has a combination dispersion and skimming device wherein a tank includes a telescoping tube having an adjustable height and a skimmer positioned on the end of the tube. Additionally, Applicant is unaware of any previous device that returns skimmed matter through a dispersion tube having a series of openings that allow the matter to be dispersed throughout the entire mixture or only a portion of the mixture.

Applicant is also unaware of any prior art device that teaches the use of an adjustable intake tube that is impervious to damaging forces resulting from the circulation of fluids. Such forces are particularly troublesome in the case of heavy fluids such as asphalt.

Consequently, it is desirable to provide a combination dispersion and skimming device and method wherein the device has an adjustable intake tube so that floating substances, having a lower specific gravity, may be skimmed from the surface and dispersed throughout the mixture.

Further, it is desirable to provide an adjustable intake tube wherein the tube may be located centrally within the tank, thereby minimizing detrimental forces acting on the intake tube due to circulation of the mixture within the tank.

Additionally, it is desirable to utilize a dispersion tube so that material of lower specific gravity may be reinjected into the tank at locations throughout different areas of the tank, thereby effecting a more thorough mixing of materials of high and low specific gravities.

SUMMARY OF THE INVENTION

The present invention provides a mixing system and method that thoroughly mixes substances. The invention is particularly effective for mixing relatively low specific gravity substances with relatively high specific gravity substances. The mixing system of the present invention may be used to mix liquid and solid materials having different specific gravities, such as asphalt having a relatively high specific gravity and rubber or latex, which has a relatively low specific gravity. The high specific gravity rubber or latex tends to rise and float on the upper surface of the asphalt. The system may also be used to disperse one liquid into another, more viscous, liquid. Additionally, the mixing system may be used to disperse chemicals or additives throughout a mixture.

The mixing system is comprised of a tank containing a liquid mixture or a mixture of liquids and solids. In the preferred embodiment, the tank is vertical with cylindrical side walls. An alternate embodiment includes the use of a horizontally oriented tank having a cylindrical side wall. However, other tank configurations may be used.

Positioned within the tank is an adjustable tube having an intake. The tube is adjustable for positioning the intake proximate the upper surface or liquid level of the mixture. By providing an adjustable tube, matter having a low specific gravity, which is separated from the mixture and floating on the surface of the mixture, may be drawn through the adjustable tube where it may be dispersed back into the mixture.

In the preferred embodiment, the adjustable tube is capable of telescoping and is preferably positioned in the center of the tank. By positioning the telescoping tube in the center of the tank, the tube is substantially unaffected by forces from rotating liquids within the tank. Such forces may be particularly troublesome when circulating heavy liquids such as asphalt. In the preferred embodiment, the telescoping tube is supported by a structural support to provide increased strength.

The mixing system also includes a pump or other circulation means, such as, but not limited to, a centrifugal pump or other type of pump, wherein the pump is for drawing matter through the adjustable tube. The mixing system further includes a dispersion tube for receiving matter from the pump. In the preferred embodiment, the dispersion tube is positioned proximate a wall of the tank. Preferably, the dispersion tube has a plurality of orifices fashioned over the length of the dispersion tube so that matter may be dispersed through all portions of the mixture. Additionally, it is desirable to position the orifices in a direction substantially tangential to the wall of the tank for inducing a sweep or rotation of the mixture in the tank.

To facilitate control of the dispersion of matter back into the tank mixture, a flow restrictor may be provided within the dispersion tube. Preferably, the flow restrictor includes a plunger positioned within the dispersion tube that is vertically adjustable therein. By positioning the plunger proximate the top of the dispersion tube, matter is allowed to exit all orifices of the dispersion tube, thereby dispersing the matter throughout the mixture in the tank. By positioning the plunger at a lower position in the dispersion tube, the dispersion of matter is limited to, the lower portion of the mixture in the tank.

Alternatively, cut-off valves may be provided at various locations along the dispersion tube. The cut-off valves permit an operator to cut off a flow at a specific desired location. Limiting the flow of matter into the tank mixture to a lower region of the tank mixture may be desirable in situations where the materials to be mixed have widely disparate specific gravities.

Finally, either a manual or automatic means is preferably provided so that the adjustable tube may be easily raised or lowered. In the preferred embodiment, the telescoping tube engages a reversible screw drive that raises and lowers the telescoping tube. However, other types of manual or automatic means may be used including, but not limited to, an electric motor employing a chain drive, a hydraulic or pneumatic lift or other means. Additionally, the raising and lowering means may respond to a fluid level sensor rod provided in the tank. By utilizing a fluid level sensor rod, the raising and lowering means will enable the height of the telescoping tube to be adjusted to the upper surface or liquid level of the mixture, thereby optimizing the ability of the system to pull low specific gravity substances off the top of the mixture and disperse such substances throughout the mixture in the tank.

DETAILED DESCRIPTION OF THE PREFERRED EMBODIMENTS

Figure 1:
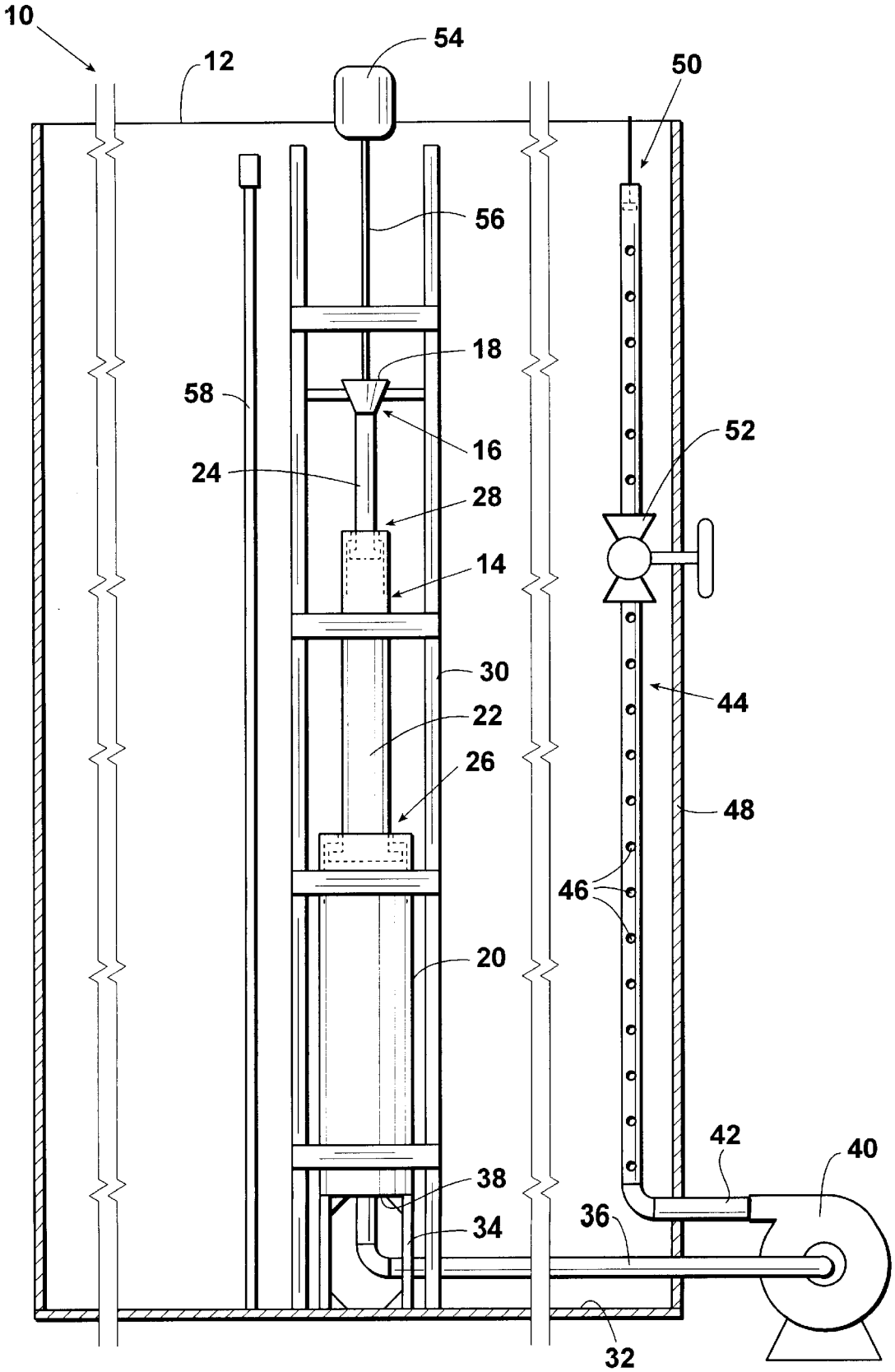
FIG. 1 is a cross-sectional side elevation view of a vertical embodiment of the invention.

Referring now to FIG. 1, a partial cross-sectional elevation view of a vertical embodiment of mixing system 10 is shown. Mixing system 10 includes tank 12 for containing a mixture therein. An adjustable tube, such as telescoping tube 14, is positioned within tank 12 and is vertically adjustable for positioning intake 16 proximate an upper surface or liquid level of a mixture for drawing in matter from the surface or near the surface of the mixture. In the preferred embodiment, intake 16 is provided with funnel or skimmer 18. Additionally, in the preferred embodiment, telescoping tube 14 is formed from three tubular segments. However, any form of vertically adjustable tube may be used. Preferably, the lowermost and largest segment is first tube segment 20. Received within first tube segment 20, and of a smaller diameter than first tube segment 20, is second tube segment 22. Similarly, received within second tube segment 22, and smaller in diameter than second tube segment 22, is third tube segment 24.

Preferably, first tube segment 20, second tube segment 22 and third tube segment 24 are joined together by first catch ring assembly 26 and second catch ring assembly 28, respectively. Catch ring assemblies 26 and 28 are of similar construction. For illustrative purposes, catch ring assembly 28 will be discussed in greater detail in FIG. 2.

Telescoping tube 14 is preferably positioned centrally within tank 12 and is substantially vertical so that forces acting on telescoping tube 14 from a circulation of the mixture are minimized. In the preferred embodiment, telescoping tube 14 is supported by funnel support or structural support 30. Funnel or structural support 30 is discussed in greater detail in relation to FIG. 3.

Preferably, telescoping tube 14 is supported off of tank floor 32 by tube supports 34. By positioning telescoping tube 14 off of tank floor 32, horizontal intake tube 36 can engage bottom 38 of telescoping tube 14. Horizontal intake tube 36 is connected to bottom 38 of telescoping tube 14 on one end and engages pump 40 on the other end. Pump 40 may be a centrifugal pump or other type of pump or other means to induce circulation.

Connected to an outlet of pump 40 is horizontal outlet tube 42 for connection with dispersion tube 44. In the preferred embodiment, dispersion tube 44 is provided with a plurality of orifices 46 which are fashioned over the entire length of dispersion tube 44. Most preferably, orifices 46 have a one-inch diameter and are positioned six inches apart from one another. In the preferred embodiment, dispersion tube 44 is positioned proximate tank wall 48 and orifices 46 are positioned to disperse matter in a direction substantially tangential to tank wall 48 for inducing a sweep or circulation of the mixture within tank 12.

By providing a plurality of orifices 46 at varying distances from tank floor 32, matter is dispersed throughout the mixture. Optionally, a flow restrictor, such as plunger 50, may be provided within dispersion tube 44 for restricting the dispersion of matter to a selected area of tank 12. For example, plunger 50 may be positioned proximate a midpoint of the tank. By positioning plunger 50 in this manner, all orifices 46 above plunger 50 receive no matter for dispersion. In this manner, matter is dispersed only in a bottom region of tank 12.

Plunger 50 is discussed in greater detail with reference to FIG. 5 below.

Another embodiment of a flow restrictor is cutoff valve 52, shown on dispersion tube 44. Cutoff valve 52 may be positioned wholly within tank 12 or may be accessible through tank wall 48, as shown, to facilitate easier access by an operator. Any number of cutoff valves may be provided over the length of dispersion tube 44, depending upon the degree of control desired by an operator.

Preferably, a means for automatically raising and lowering telescoping tube 14 is provided. Means for automatically raising and lowering telescoping tube 14 is preferably reversible screw drive motor 54. Other raising and lowering means may be provided, such as a chain driven motor or a hydraulic or pneumatic raising and lowering means. In the preferred embodiment, reversible screw drive motor 54 engages third tube segment 24 via screw 56. To facilitate automatic raising and lowering of telescoping tube 14, fluid level sensor rod 58 may be provided to detect the level of matter within tank 12 and to adjust the height of telescoping tube 14 via reversible screw drive motor 54 accordingly. An interface between fluid level sensor rod 58 and reversible screw drive motor 54 is provided as is commonly known in the art.

Optionally, an auxiliary mixer preferably located between pump 40 and dispersion tube 44 may be provided. In the preferred embodiment, horizontal intake tube 36 is connected with the auxiliary mixer via an upstream mixer tube.

Optionally, a chemical injection tube may be inserted upstream of the upstream mixer tube for injecting additives. Mounted interiorly of the upstream mixer tube are braces, which are provided to keep the circulating mixture from pushing the chemical injection tube out of position. The chemical injection tube should preferably extend at a minimum to the mouth or intersection point of the horizontal intake tube with the upstream mixer tube or, alternatively, maximally one tee radius past the mouth of the injection tee.

An auxiliary mixer, preferably a Lightnin™ static mixer installed backwards, is provided downstream of the mouth for farther mixing of the mixture or additives. The auxiliary mixer is formed with an expansion chamber, wherein the mixing is facilitated.

Figure 2:
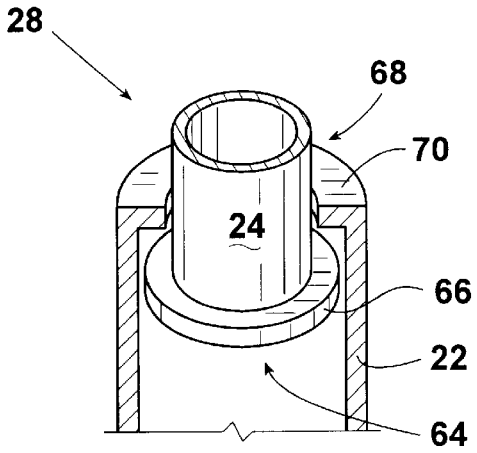
FIG. 2 is a partial cross-sectional perspective view of a catch ring assembly of FIG. 1.

Referring now to FIG. 2, shown is second catch ring assembly 28, which slidably connects second tube segment 22 and third tube segment 24 of telescoping tube 14. Fashioned on bottom 64 of third tube segment 24 is catch ring 66. Fashioned on top 68 of second tube segment 22 is annular plate 70. In the preferred embodiment, a one-eighth inch gap is provided between annular plate 70 and third tube segment 24. Similarly, it is preferred that a one-eighth inch gap is provided between catch ring 66 and the inside of second tube segment 22.

Although FIG. 2 shows the second catch ring assembly 28, it is to be understood that a similar assembly may be provided between any telescoping tube segments.

Figure 3:
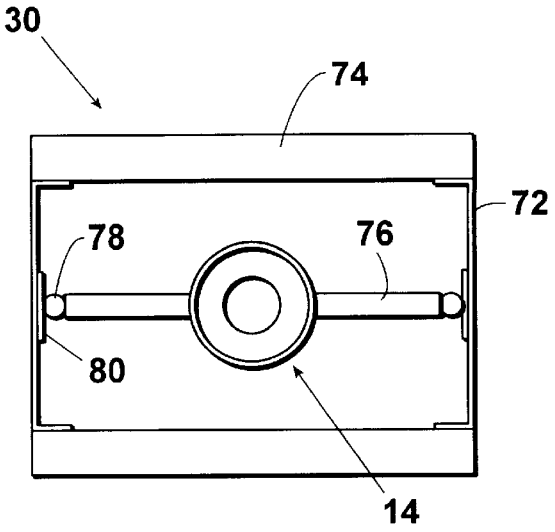
FIG. 3 is a top plan view of the funnel support of FIG. 1.

Referring now to FIG. 3, shown is a top view of funnel or structural support 30. In the preferred embodiment, structural support 30 includes vertical structural members 72, preferably made from perforated channel beam. Vertical structural members 72 are connected together by horizontal structural members 74. Telescoping tube 14 is provided with guides 76. Guides 76 have runners 78 affixed thereto for engaging runner pads 80. By providing structural support 30, damage to telescoping tube 14 from circulating fluids is minimized.

Alternatively, an alternate structural support (not shown) may be employed. Second tube segment 22 and third tube segment 24 may rest on an internal support stand held within first tube segment 20, placing tube supports 34 internal to segment 20 allowing first tube segment 20 to be attached to the floor of the tank.

Figure 4:
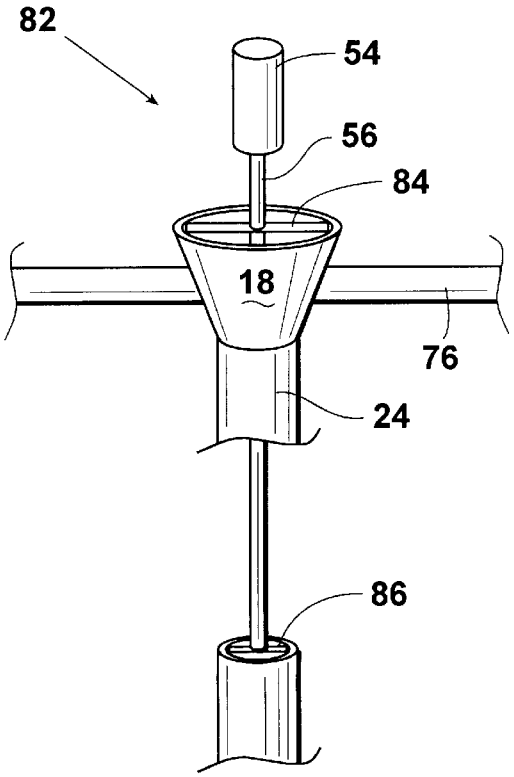
FIG. 4 is a perspective view of the screw drive system of FIG. 1.

Referring now to FIG. 4, shown is a detail of screw drive system 82. Affixed to reversible screw drive motor 54 is screw 56. Screw 56 passes through screw stabilizer 84, which is preferably positioned within funnel 18. Funnel 18 is shown affixed to third tube segment 24. Located within third tube segment 24 is pivot attachment 86. When reversible screw drive motor 54 rotates screw 56 such that third tube segment 24 is raised, catch ring 66 (shown in FIGS. 1 and 2) engages annular plate 70 to lift second tube segment 22. A similar action occurs regarding any number of lower tube segments.

Figure 5:
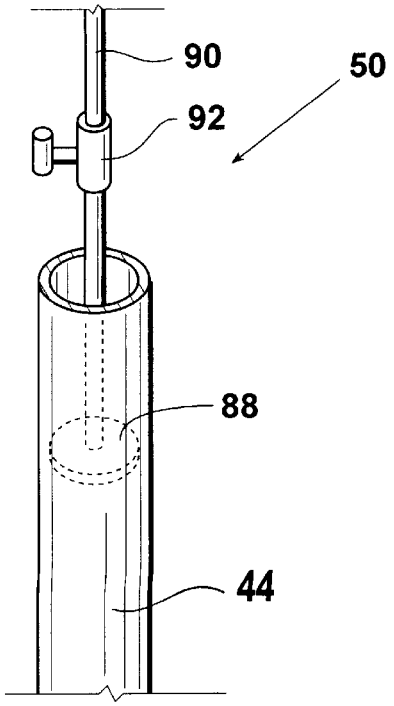
FIG. 5 is a perspective view of the plunger of FIG. 1.

Referring now to FIG. 5, shown is plunger 50. Plunger 50 is formed from plunger disk 88, which is attached to plunger rod 90. Plunger disk 88 is positioned within dispersion tube 44 for blocking the flow therein. In the preferred embodiment, plunger rod 90 passes through fixed clamp 92 so that plunger disk 88 may be positioned at a desired height within dispersion tube 44.

Figure 7:
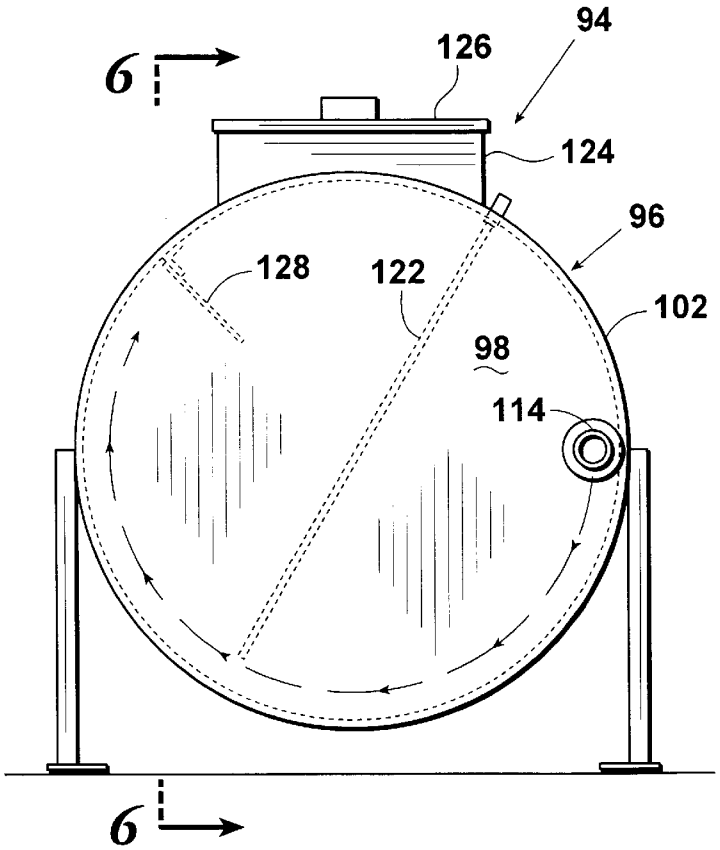
FIG. 7 is an end elevation view of a horizontal embodiment of the invention of FIG. 6.
Figure 6:
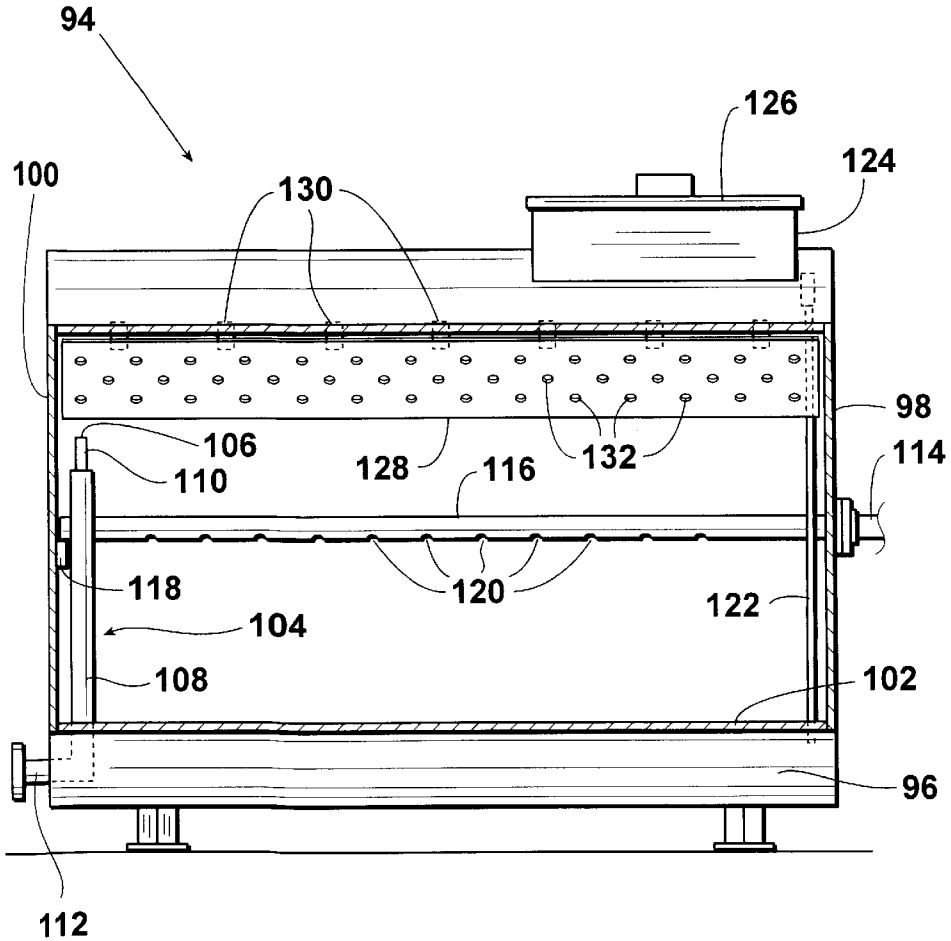
FIG. 6 is a partial cross-sectional elevation view of the horizontal embodiment of the invention, taken along line 6—6 of FIG. 7.

Referring now to FIGS. 6 and 7, FIG. 6 is a partial cross-sectional elevation view of a horizontal embodiment 94 of the invention, taken along line 6—6 of FIG. 7. FIG. 7 is an end elevation view of horizontal embodiment 94. Horizontal embodiment 94 includes horizontal tank 96 having a first end 98, a second end 100 and cylindrical wall 102. A telescoping tube 104 is positioned within horizontal tank 96 and is vertically adjustable for positioning intake 106 proximate an upper surface or liquid level of a mixture for drawing in matter from the surface or near the surface of the mixture.

In the embodiment shown in FIG. 6, telescoping tube 104 is comprised of a first segment 108 and a second segment 110. Segments 108 and 110 may be slidably connected to one another through a catch ring assembly similar to that shown in FIG. 2 or by some other means. Telescoping tube 104 is connected to intake tube 112. Intake tube 112 engages a pump (not shown), which draws material through telescoping tube 104 and intake tube 112. Material is circulated by the pump back into horizontal tank 96 of the mixing system through outlet tube 114. Preferably, pump outlet tube 114 passes through first end 98 proximate cylindrical wall 102.

Interfacing with pump outlet tube 114 is dispersion tube 116. Preferably, dispersion tube 116 traverses horizontal tank 96 from a point proximate first end 98 to second end 100. Rest bracket 118 may be provided on second end 100 to support dispersion tube 116. In the preferred embodiment, dispersion tube 116 has a plurality of orifices 120 formed over its length. Orifices 120 preferably are directed tangentially with respect to cylindrical wall 102 for inducing circulation of the material within horizontal tank 96.

Preferably, fluid level sensor rod 122 is provided to supply fluid level information for automatically raising and lowering telescoping tube 104 in the manner discussed with reference to FIG. 1.

In the preferred embodiment, horizontal tank 96 is provided with access port 124, having cover 126. Baffle plate 128 prevents incoming material from splashing out of the tank and injuring an operator. Preferably, baffle plate 128 is perforated, twelve inches wide, and mounted on mounting brackets 130 which maintain baffle plate 128 one inch from cylindrical wall 102. Baffle plate 128 has a plurality of orifices 132, provided therein. Orifices 132 are preferably one-inch diameter holes placed on six-inch centers and are provided in three rows that are three inches apart. As shown in FIG. 7, baffle plate 128 provides a stop for circulating fluid emanating from dispersion tube 116, the flow of which is indicated by the arrows in FIG. 7.

Whereas, the present invention has been described in relation to the drawings attached hereto, it should be understood that other and further modifications, apart from those shown or suggested herein, may be made within the spirit and scope of this invention.

What is claimed is:

1. A mixing system comprising:

a tank for containing a mixture;

an adjustable tube having an intake, said tube located within said tank and adjustable for positioning said intake proximate an upper surface of the mixture for only drawing in matter from proximate the surface of the mixture;

a pump for drawing matter through said adjustable tube; and a dispersion tube within said tank for receiving the matter from said pump, said dispersion tube having a plurality of orifices for dispersing the matter over a length of said dispersion tube within said tank.

2. A mixing system according to claim 1, wherein said adjustable tube is a telescoping tube.

3. A mixing system according to claim 2, wherein said telescoping tube is positioned centrally within said tank and substantially vertical to a floor of said tank, said telescoping tube so positioned for minimizing forces on said tube from a circulation of the mixture.

4. A mixing system according to claim 2, further comprising a structural support for supporting said adjustable tube.

5. A mixing system according to claim 1, further comprising a circular opening parallel to said surface and in fluid communication with said intake of said adjustable tube.

6. A mixing system according to claim 1, wherein said dispersion tube is positioned proximate a wall of said tank, said dispersion tube having said orifices positioned to disperse matter in a direction substantially tangential to a wall of said tank for inducing a circulation of the mixture in said tank.

7. A mixing system according to claim 1, wherein said orifices of said dispersion tube are positioned at a plurality of distances from a floor of said tank.

8. A mixing system according to claim 7, further comprising a flow restrictor within a portion of said dispersion tube for restricting dispersion of matter to a selected area of said tank.

9. A mixing system according to claim 8, wherein said flow restrictor is a plunger, said plunger positioned within said dispersion tube and vertically adjustable therein.

10. A mixing system according to claim 8, wherein said flow restrictor is a cut-off valve positioned on said dispersion tube for restricting flow therein.

11. A mixing system according to claim 1, further comprising a means for automatically raising and lowering said adjustable tube.

12. A mixing system according to claim 1, further comprising positioning a baffle plate proximate a wall of said tank and extending outwardly therefrom, said baffle plate for preventing the mixture from splashing out of said tank.

13. A mixing system according to claim 1 wherein said mixture contains substances of different specific gravities.

14. A method of mixing a relatively low specific gravity substance and a relatively high specific gravity substance comprising the steps of:

containing the relatively low specific gravity substance and the relatively high specific gravity substance within a tank;

positioning an intake of an adjustable tube proximate an upper surface of said substances;

skimming the relatively low specific gravity substance from said upper surface with said intake of said adjustable tube; and recirculating said relatively low specific gravity substance through a dispersion tube having a plurality of orifices for dispersing said substance throughout said tank at selected vertical distances from a floor of said tank.

15. A mixing system comprising:

a cylindrical tank for containing a mixture of substances having different specific gravities, said tank having an axis and a continuous wall;

an adjustable intake tube for only drawing in said mixture proximate an upper surface of said mixture, said intake tube parallel to said axis and adjustable axially to said upper surface of said mixture;

a dispersion tube within said tank parallel to said tank axis, having a plurality of axially aligned openings; and a pump for drawing said mixture into said intake tube and through said dispersion tube.

* * * * *